US007909277B2

(12) United States Patent
Doppstadt et al.

(10) Patent No.: US 7,909,277 B2
(45) Date of Patent: Mar. 22, 2011

(54) COMMINUTION DEVICE

(75) Inventors: Johann Doppstadt, Velbert (DE); Horst Berger, Calbe (DE)

(73) Assignee: Doppstadt Calbe GmbH, Calbe/Saale (DE)

( * ) Notice: Subject to any disclaimer, the term of this patent is extended or adjusted under 35 U.S.C. 154(b) by 122 days.

(21) Appl. No.: 11/989,720

(22) PCT Filed: Apr. 25, 2007

(86) PCT No.: PCT/EP2007/003648

§ 371 (c)(1),
(2), (4) Date: Jan. 30, 2008

(87) PCT Pub. No.: WO2007/122004

PCT Pub. Date: Nov. 1, 2007

(65) Prior Publication Data

US 2009/0121058 A1 May 14, 2009

(30) Foreign Application Priority Data

Apr. 25, 2006 (DE) ..... 20 2006 006 802 U

(51) Int. Cl.
*B02C 18/16* (2006.01)

(52) U.S. Cl. ..... 241/73; 241/243; 241/300; 241/300.1

(58) Field of Classification Search ..... 241/73, 241/243, 242, 300, 300.1
See application file for complete search history.

(56) References Cited

U.S. PATENT DOCUMENTS

| | | | | | |
|---|---|---|---|---|---|
| 2,261,090 | A | * | 10/1941 | Lind | 241/82 |
| 3,779,123 | A | * | 12/1973 | Chafee | 83/698.41 |
| 4,385,732 | A | * | 5/1983 | Williams | 241/236 |
| 5,052,630 | A | * | 10/1991 | Hinsey et al. | 241/36 |
| 6,094,795 | A | * | 8/2000 | Davenport | 29/407.1 |

FOREIGN PATENT DOCUMENTS

| | | | |
|---|---|---|---|
| DE | 195 20 982 | | 12/1995 |
| DE | 297 18 512 | | 1/1998 |
| DE | 298 18 720 | | 5/1999 |
| DE | 299 10 772 | | 12/1999 |
| DE | 29910770 | * | 12/1999 |
| EP | 1 442 796 | | 8/2004 |

OTHER PUBLICATIONS

German Search Report (English and German) dated Mar. 7, 2007.
International Search Report dated Aug. 8, 2007.

* cited by examiner

*Primary Examiner* — Mark Rosenbaum
(74) *Attorney, Agent, or Firm* — Jacobson Holman PLLC

(57) ABSTRACT

A comminution device including at least one comminution cylinder supported rotating in a machine frame with at least one comminution tool arranged on it, and at least one counter cutter interacting with the comminution tool, and at least one sieve device for the comminuted material the housing of which encircles the comminution cylinder at least partly, the sieve device and the counter cutter forming a common structural component. The counter cutter is designed like a plate and has recesses designed corresponding to the shape of the comminution tools of the comminution device.

18 Claims, 11 Drawing Sheets

COMMINUTION DEVICE

Figure 1:
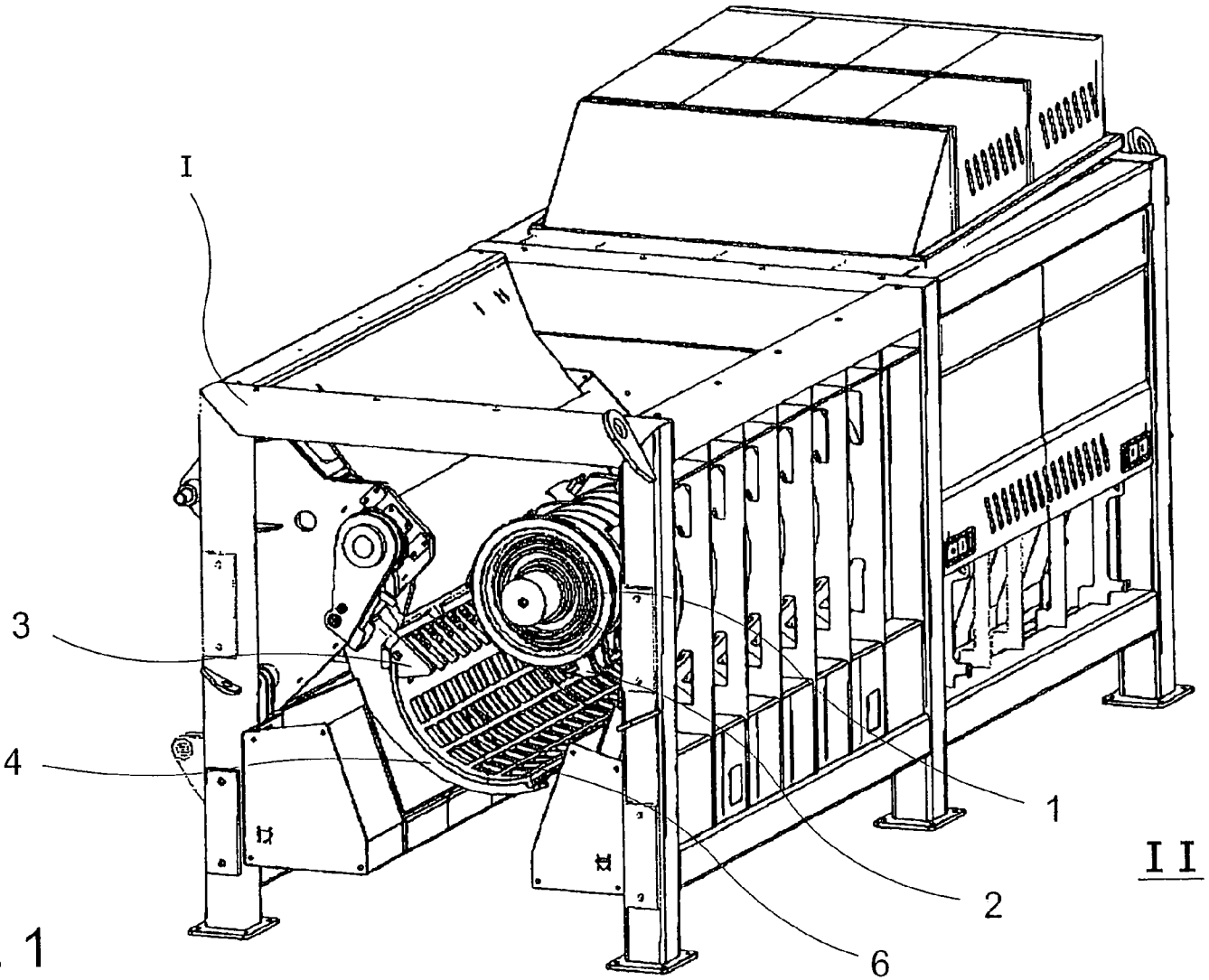

This is a national stage of PCT/EP07/003648 filed Apr. 25, 2007 and published in German.

The invention refers to a comminution device for comminuting different materials.

Comminution devices of this type are known in different embodiments. They comprise a comminution cylinder supported rotating in a machine frame with at least one comminution tool arranged on it, and at least one counter cutter interacting with the comminution tool. Furthermore the known comminution devices have at least one sieve device for the comminuted material the housing of which encircles the comminution cylinder at least partly. The encircling of the housing by the sieve device is necessary in order to collect the comminuted material completely.

The comminution cylinder usually has a number of comminution tools interacting with a corresponding number of counter cutters or with a one-piece counter cutter. The counter cutter may be also formed as plate having a number of recesses as counter cutters corresponding with the number of cutters.

The sieve device here encircles the entire length of the comminution cylinder in order to collect the entire comminuted material completely. The problem now is the fact that, when the sieve device is clogged or the size of the opening of the sieve device changes, not only the sieve device has to be dismantled but also the counter cutter. The arrangement usual so far of the counter cutters below the cylinders or the arrangement on a separate counter cutter carrier designed like a stand makes dismantling and also mounting more difficult. Additionally then the counter cutter has to be adjusted anew again on the cylinder. This takes time, and is, in particular when the cutters, the cylinders or the sieve device are exchanged, very time consuming what extends the stand still times of comminution devices of this type, and thus leads to an increasing of the costs.

Also exchanging the sieve device for a desired altered graining of the sieved material becomes very complicated. As a rule, the counter cutter as well as the sieve device has to be exchanged what leads to the disadvantageous effects already described.

The invention comes from the state of the art described before, and has the object of suggesting a comminution device as described before where the mounting and dismantling of the sieve device and the counter cutter is designed substantially simpler.

In order to solve the problem the invention suggests a comminution device comprising at least one comminution cylinder supported rotating on a machine frame with at least one comminution tool arranged on it, and at least one counter cutter interacting with the comminution tool, and with at least one sieve device for the comminuted material the housing of which encircles the comminution cylinder at least partly, the sieve device and the counter cutter forming a common structural component which is characterised in that the counter cutter is designed like a plate and has recesses designed corresponding to the shape of the comminution tools of the comminution device.

By means of such a design now a fast and easy exchange of the complete unit comprising sieve device and counter cutter is possible. This exchange may also be carried out without the necessity to dismantle, for example, the comminution cylinder. Of course, also the exchange of the comminution cylinder is made easier when this has to be carried out necessarily at the same time. The solution according to the invention leads to a substantial reduction of the standstill times which are described as disadvantageous. Furthermore, it is possible to store an exchange system where, for example, different grainings for a sieve device are stored. Synchronously these sieve devices with different counter cutters (corresponding to the desired knife sizes) can be stored. Because of the fact that counter cutter and sieve device can be mounted as well as dismantled together as structural component, also one exchange system can be stored. This exchange system reduces the standstill times of the comminution device further because, for example, necessary repairs of the sieve device and the counter cutters can be carried out when the comminution device is already in operation again.

The comminution tools run through the recesses during the rotating movement of the cylinder when the comminution tools are in operation. According to that also the shape of the recesses is designed corresponding to the comminution tools. The counter cutter in the present embodiment of the invention is plate-shaped, that means it may be formed by one continuous plate which extends across the complete width of the comminution cylinder. In this design the counter cutter is also, according to the invention, arranged in the top area at the sieve device. The attaching is done, for example, in another embodiment of the invention by means of clamping with wedges. Of course, also other possibilities of attaching are comprised by the invention. The invention is not restricted to this one form of an attachment of the counter cutter.

A development of the invention provides that the counter cutter is arranged at the sieve device in the direction of fitting. This design according to the invention is, in contrast to all solutions known so far, characterised in that the counter cutter is provided exactly opposite the arrangement usual so far in the bottom area of the sieve device. A change of the rotational direction of the cylinder makes the cutters or the cylinders stroke still across the sieve device in order to press, if necessary, the already disintegrated material through the openings. For an exchange of the complete structural component this arrangement has proved to be in particular positive. It even can be obtained, compared with the solutions known in the state of the art, considerably easier, and in particular be stored. Also the ease of servicing of such an arrangement is essentially improved.

A development of the solution described before suggests that the counter cutter is designed like a segment in such a way that individual segments of the counter cutter can be exchanged or substituted. This has the advantage that, when single teeth of the counter cutter are worn, the concerned segments can be exchanged or substituted so that on the one hand the effort for the exchange is reduced, and, on the other hand, the expenses for the exchange material can also be kept low.

Another aspect of the preceding solution suggests that the counter cutter is designed plate-like, in the direction of cutting one or more wearing plates being provided on the plate-shaped counter cutter. Exactly with coarse crushing it often happens that not desired parts of the material to be comminuted, for example nails, screws, bolts or the like, are contained in this material so that during comminuting the material of cutter and counter cutters has to withstand higher requirements. For this reason it is provided to arrange at least one wearing plate on the counter cutter. By arranging several wearing plates it is possible to remove them simply when worn, and then the work can be continued immediately.

According to the invention it has been found to be an advantage if the wearing plate or the wearing plates are arranged releasably fixed on a counter cutter support body. This serves also for improving the ease of servicing in the case of an exchange by wear or change of the material to be comminuted. It is possible here to use wearing plates of different quality with respect to their stress resistance.

The comminution device as described before is in a development of the invention characterised in that the locking or attaching of the counter cutter is provided, if necessary, together with the wearing plate by at least one wedge at the sieve device. The counter cutter is here formed by counter cutting body and wearing plate. In a segment-like design of the wearing plate or the counter cutter altogether it is, of course, provided that here the counter cutter segment has a separate locking in order to guarantee a safe hold.

A preferred development of the invention provides that the counter cutter is formed by a number of individual counter cutters which are attached individually to the sieve device. This modification is in particular preferred as here the exchange of the counter cutter elements is possible very easily, and, in particular, when only one counter cutter is worn, this can then be exchanged without any problems. Also the exchange of the counter cutters is much more easier altogether because of this design. A hoist is not necessarily required which may by actually the case with a counter cutter in one piece.

According to that the invention suggests that the individual counter cutters form a cog plate. These individual counter cutters are arranged one beside the other in such a way that they, as described before, also act as a plate for the counter cutter.

The invention also proposes that the individual counter cutters can be attached to or on a support body. This also serves for better servicing because the exchange is very easy. Furthermore, the worn counter cutters can be removed relatively easily from the support body and be replaced by new ones.

In a modification the invention suggests that as fastening means a screw, a bolt or the like is provided which is guided through a boring in the support body. By means of this, on the one hand, a safe attaching is provided. On the other hand, also the principle of exchanging is realised here. Thus it is possible to exchange the counter cutters without problems by releasing the fastening means, removing the counter cutter from the support body and replacing it by another, new counter cutter, and, after that, fixing it again.

A particularly clever modification of the invention suggests that the support body is designed in such a way that it can hold individual counter cutters of different shapes. Thus it is now possible to exchange the single counter cutters when other comminution tasks are provided, or they are worn. This may happen, of course, as in the complete concept according to the invention, when the sieve device and the counter cutter have been removed from the basket and replaced by another stored sieve device with counter cutter. Then the machine may again carry out its comminution tasks, and the repair or exchange of the counter cutters may be carried out in a normal service interval without standstill of the machine.

The invention also suggests in another embodiment that the single counter cutters are provided with wearing plates. This also serves for adjusting to very different comminution tasks. When more solid material is comminuted then counter cutters with suitable wearing plates have to be inserted which also can be quickly exchanged because the wear is higher.

In a convenient development the invention suggests that the sieve device is designed in such a way that it can be taken out of the housing. The sieve device has, in addition to that, openings serving for fractionating the comminuted material and which are arranged facing the collection side of the comminution device. The sieve device is designed preferably basket-like.

A convenient modification suggests that the structural component, comprising counter cutter and sieve device, is arranged in such a way that it can be swiveled away from or towards the comminution cylinder. By swiveling the service of sieve device and counter cutter is further improved. Thus it is now possible with smaller repairs to swivel the structural component out and to exchange single elements, for example counter cutters, or to remove cloggings in the openings of the sieve device.

A development of the invention also provides that the type or size of the openings of the sieve device can change and/or be exchanged. Depending on the desired graining by means of that a defined grain can be set for the comminuted material. This can be reached very well with a sieve device formed like a basket. The size of the openings can change in different modifications. Thus it is, for example, possible to provide insets for the openings which then are removed when larger grainings are desired. With smaller grainings another inset or an inset with other opening size is set in. The openings are designed preferably square or rectangular. Of course, they may also be formed circular or oval. The invention is not restricted to a particular shape.

The sieve device is also, in a modification of the invention, formed by individual segments forming the basket for the basket-like sieve device. Here also a very easy exchange can be carried out by just exchanging individual segments of the sieve device. Besides, these segments can be handled better by the service persons because of their weight so that either no hoist at all or a hoist of a smaller weight class is needed.

An advantageous development of the invention of the comminution device as described before is characterised in that the sieve device is designed honey-combed or has honey-combed openings. This honey-combed shape makes a convenient fractionating of the comminuted material possible.

It is an advantage when the sieve device is formed by rods designed individually or clasp-like which are arranged spaced to each other and form a basket of the sieve device. These rods or clasp-like parts of the sieve device, essentially U-shaped, open on one side, put one beside the other, form a completely new sieve device, form so to say a new basket which is protected very effectively against cloggings. An additional inset is provided by the now round form of the cog extensions and these form the sieve basket or the sieve device.

It is in particular advantageous here when the sieve device is flexible itself or is formed by flexible material. This flexible shape is in particular suited for rod-like design described before as it is relatively easily possible to obtain the rods from a spring steel or springy material. Manufacturing a complete basket from spring steel is more difficult altogether. According to that the device according to the invention, as described before, presents even essential advantages in manufacturing.

Another aspect of the invention is given by the fact that an additional inset is provided as sieve device, and the inset has been obtained in particular from flexible material which is indifferent to interfering material and/or blows. The result is also that cloggings are prevented, and in particular damages do not occur as often as in the state of the art. The sieve device is, according to that, characterised in that springs arranged individually one beside the other are provided, the springs being designed in particular clasp-like or U-shaped.

The springs may be formed from round steel, square bar steel, polygonal, oval or the like, and, in particular, from a springy material like spring steel.

The springs are adjusted, according to a development of the invention, to the curve of the comminution cylinder. This means that the springs forming the basket are arranged at least in the area where they encircle the comminution cylinder, spaced from it always with the same distance.

The invention is characterised in that a flexible basket, formed by the springs described before is provided additionally above a conventionally arranged basket so that different sieve grainings can be realised by the then provided two layers of such a sieve basket. A different fractionating can be reached by that or a repeated pre-sorting by including larger parts then again in the comminution process.

The invention is characterised in that the springs can be attached to a console, a support body or the like. It is furthermore an advantage here when the console is provided in particular swiveling in or at the comminution device.

The springs are attached to the carrier, the console or the like by means of fastening screws and flanges arranged opposite the screws and corresponding nuts. It is an advantage here when a support plate is provided at the flange serving as wearing plate and/or as a torsion safety device for the spring.

It is, of course, also possible, as suggested in a development, to attach the spring by means of clips to the console.

Seen from the side the spring is angled around an angle of 95°, and the radius of the bend of the spring is preferably 407 mm.

Furthermore, it is an advantage when the exterior radius at the U-shaped clasp at the exterior bending radius is 43 mm and at the interior bending radius is 7 mm.

Another aspect of the comminution device according to the invention is given by the fact that the sieve device as part of the system can be combined with different comminution cylinders of different diameters in such a way that different comminution tasks can be carried out with one comminution device. This also serves, of course, for increasing the universal use of this device as the comminution device is quite expensive, in order to carry out very different comminution tasks.

A development of the invention provides that the sieve device is arranged movably relatively to the machine frame. Of course, it has to be taken into consideration that the counter cutter then is not moved. In this respect here the counter cutter has to be supported movably at the sieve device in order to guarantee this function. The relative movement of the sieve device to the machine frame serves for improving the product throughput through the openings of the sieve device, and also serves for preventing cloggings.

In a development of the comminution device according to the invention it is suggested that the comminution cylinder has an electric drive. However, this does not exclude what then is provided in another modification that the sieve device has a hydraulic drive.

Of course, it is also provided that the comminution device has a drive for each the comminution cylinder and the sieve device.

The invention also suggests that the position of the comminution cylinder and the sieve device in the device is orientated essentially horizontally. Of course, other designs, for example an angled arrangement, are also comprised by the invention like the horizontal arrangement.

The sieve device is arranged in the comminution device in such a way that it encircles the comminution cylinder in the bottom area in set-up direction. This also serves for fractionating the comminuted material. It then gets through the sieve device to suitable transport means by means of which then the material comminuted in this way is removed below the sieve device. The invention provides that the sieve device encircles the comminution cylinder seen in section about around 45% to 60%. This design has proved convenient as by means of it, firstly, the filling process is not impeded, and, secondly, the comminuted material can be sufficiently disintegrated and fractionated.

The invention is characterised in that the bottom end of the sieve device and the top section form an angle of 40° to 60°, referred to the set-up plane of the device.

Figure 2:
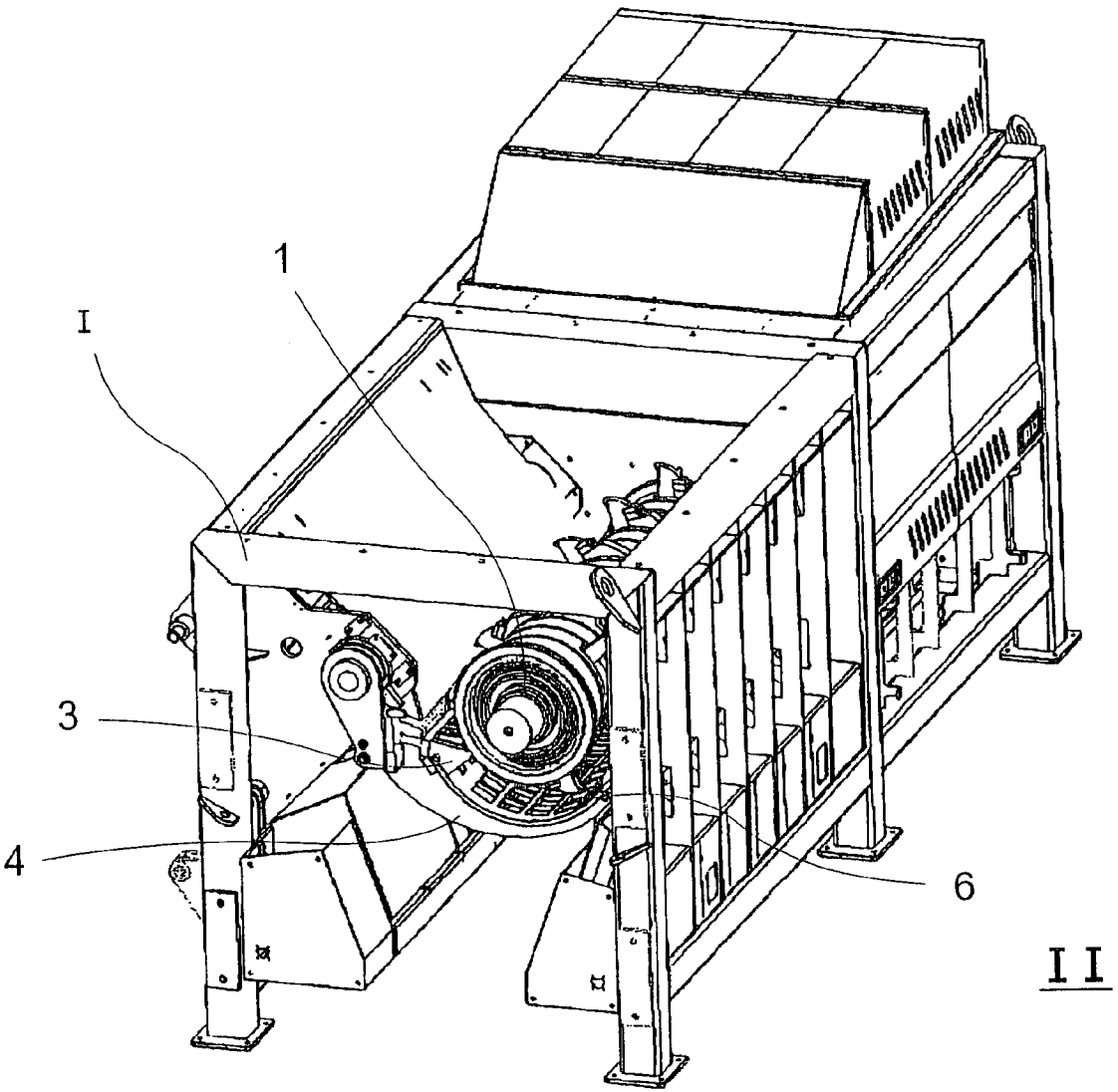
Figure 3:
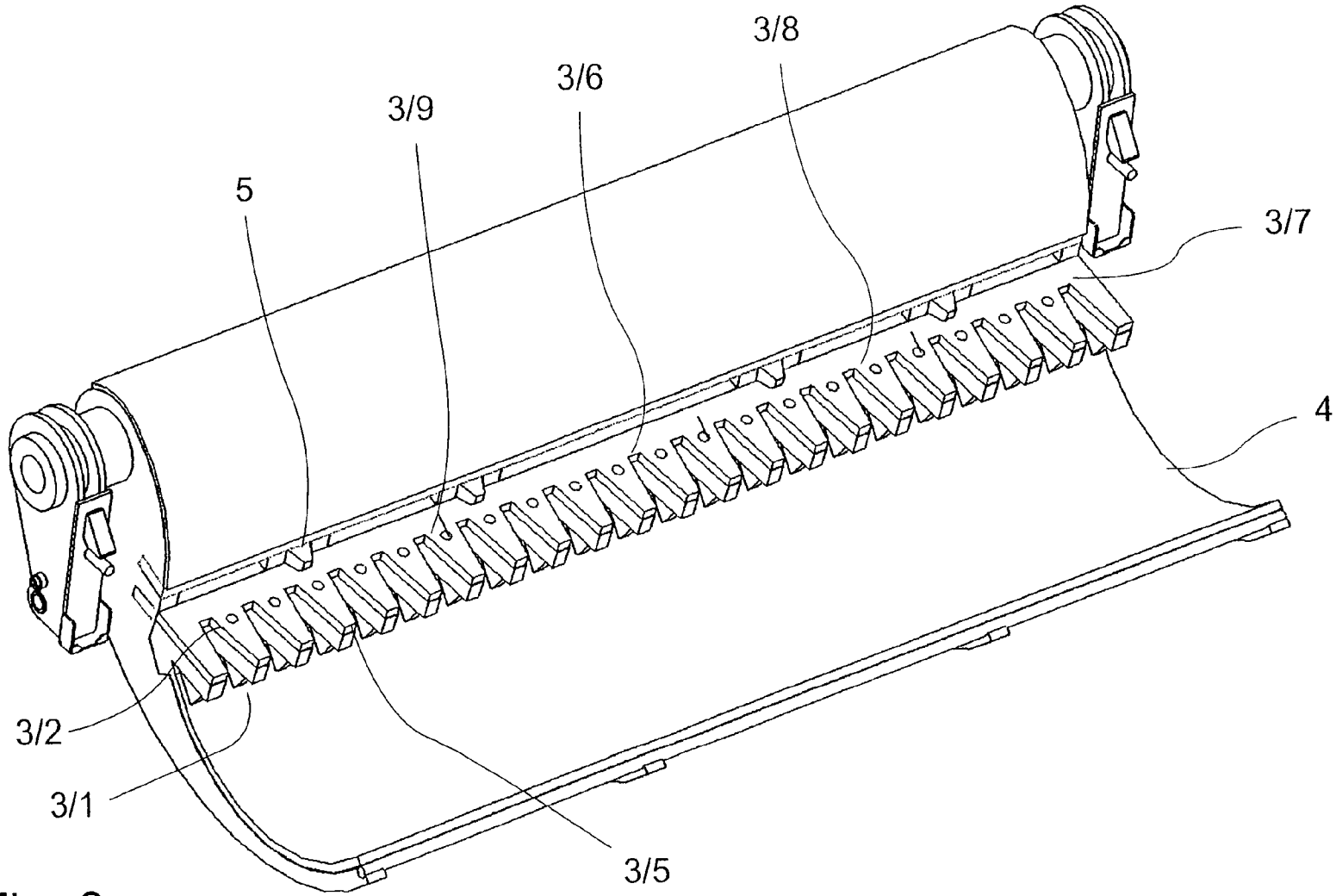
Figure 4:
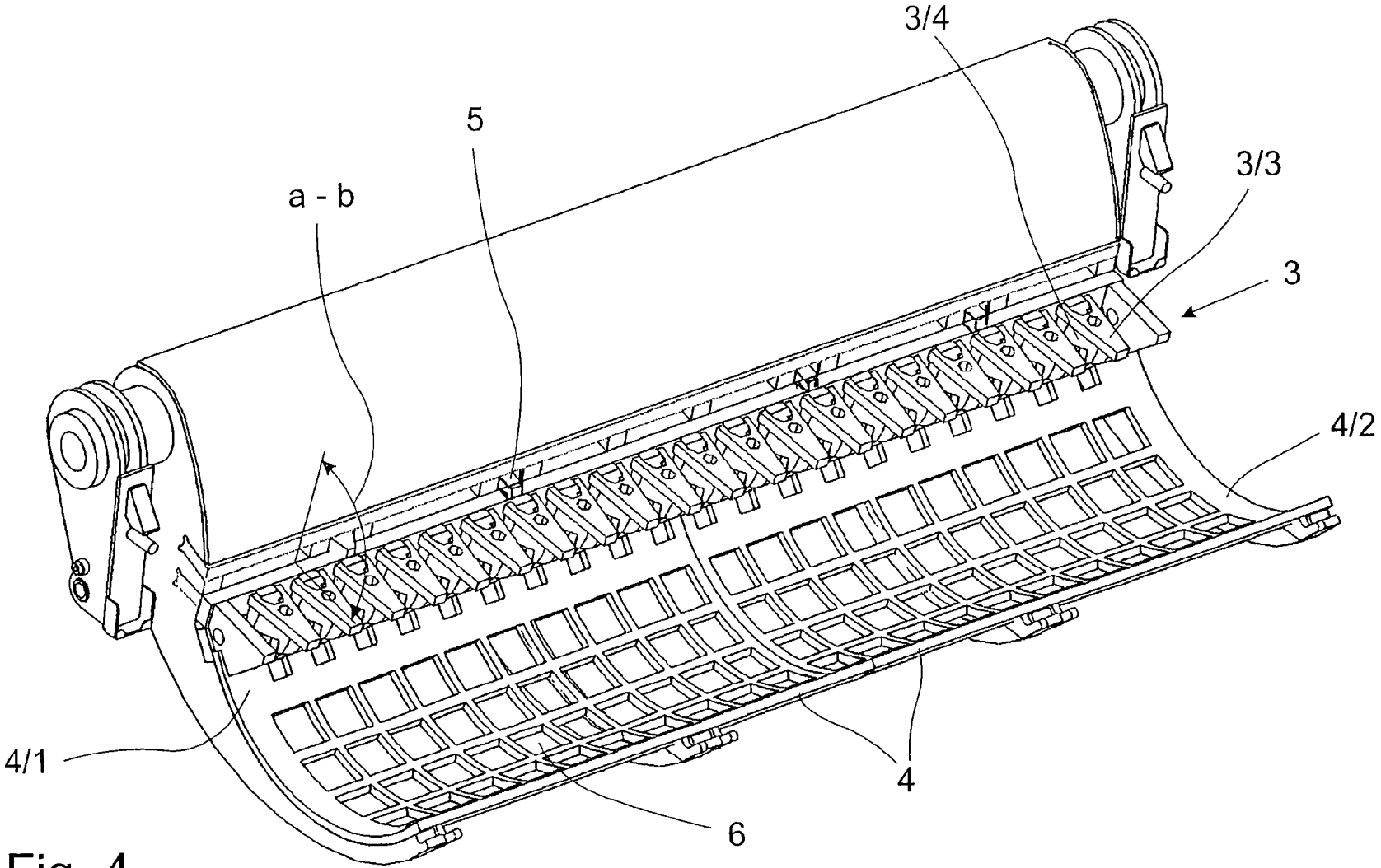
Figure 5:
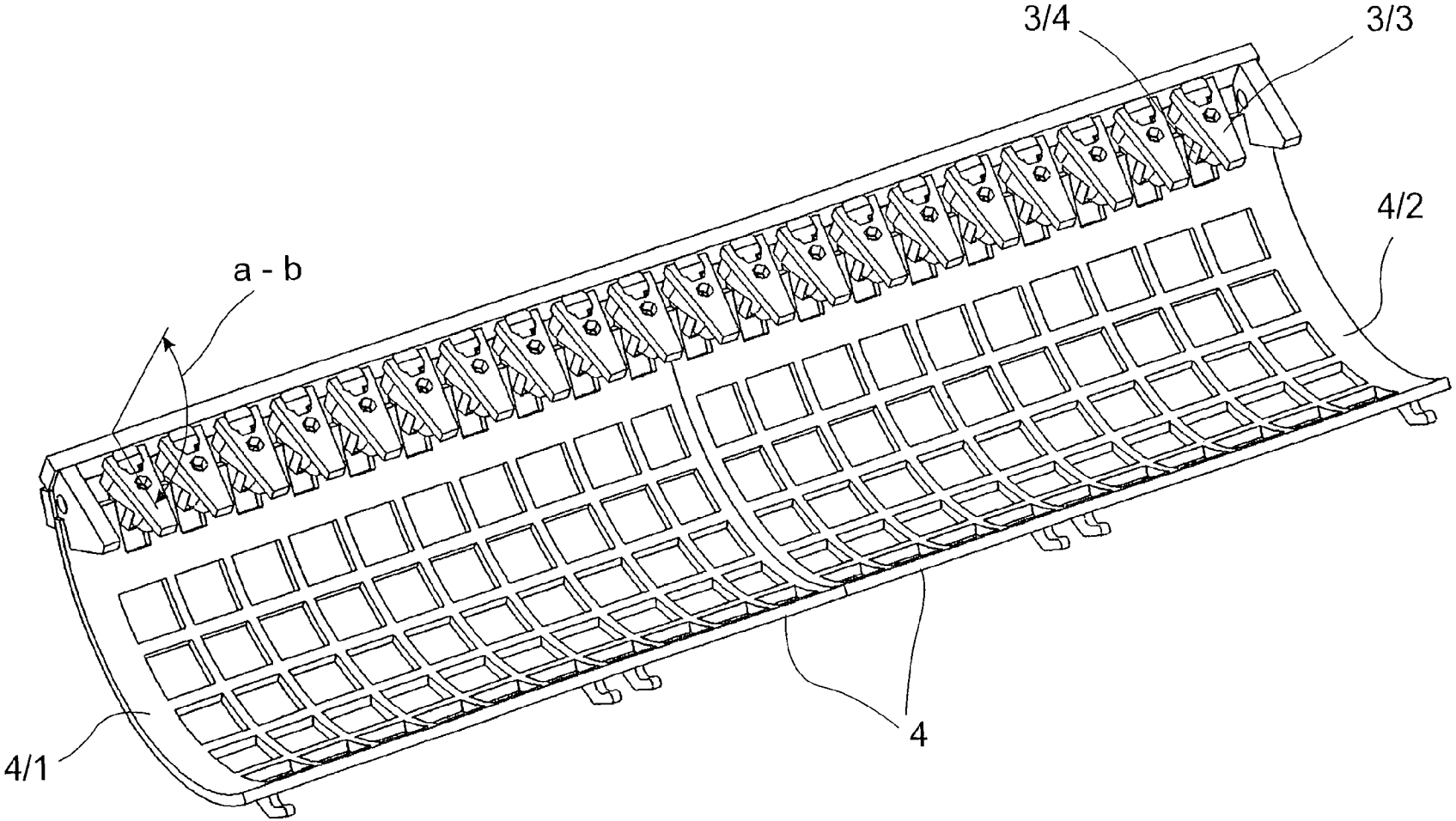
Figure 6:
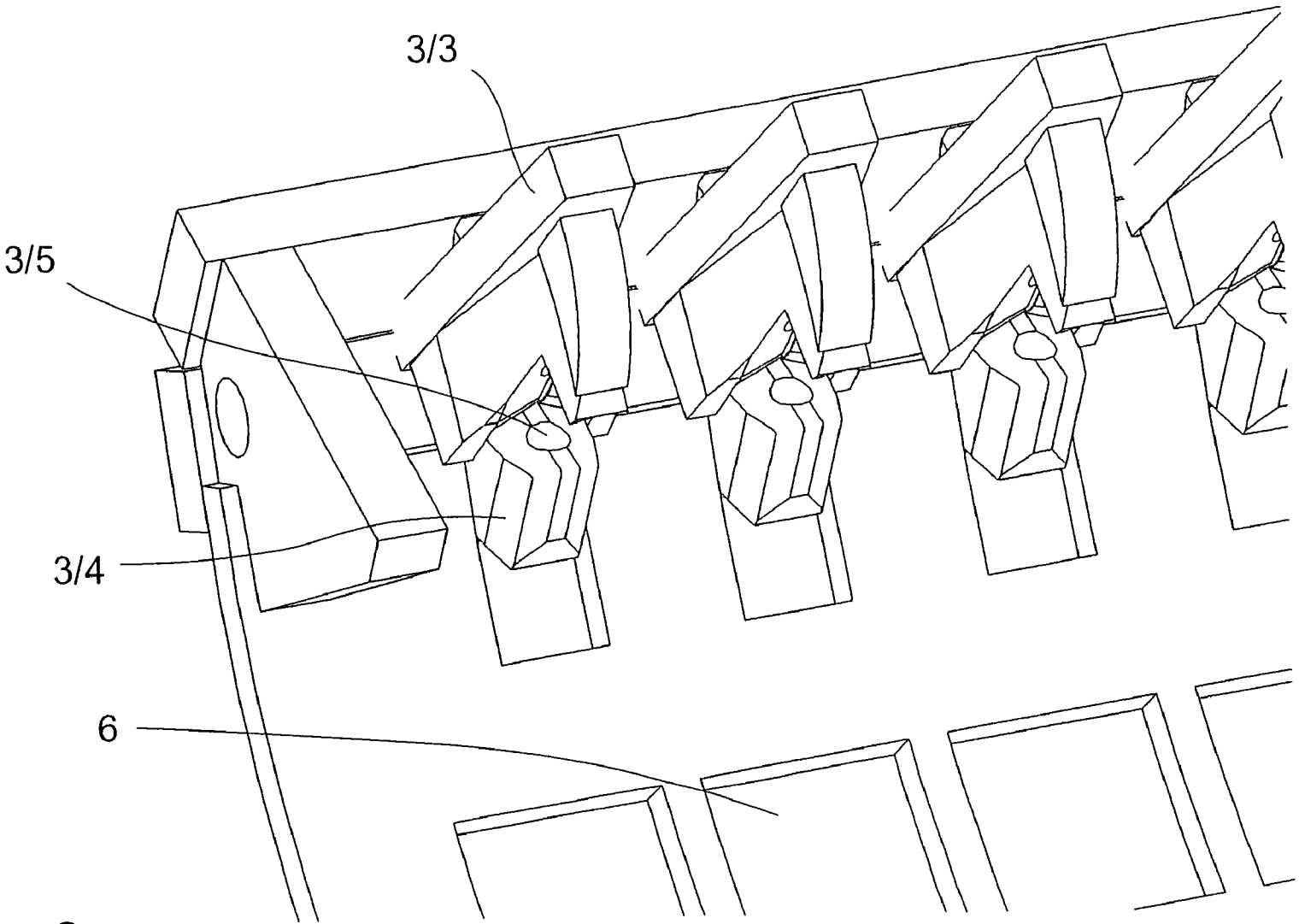
Figure 7:
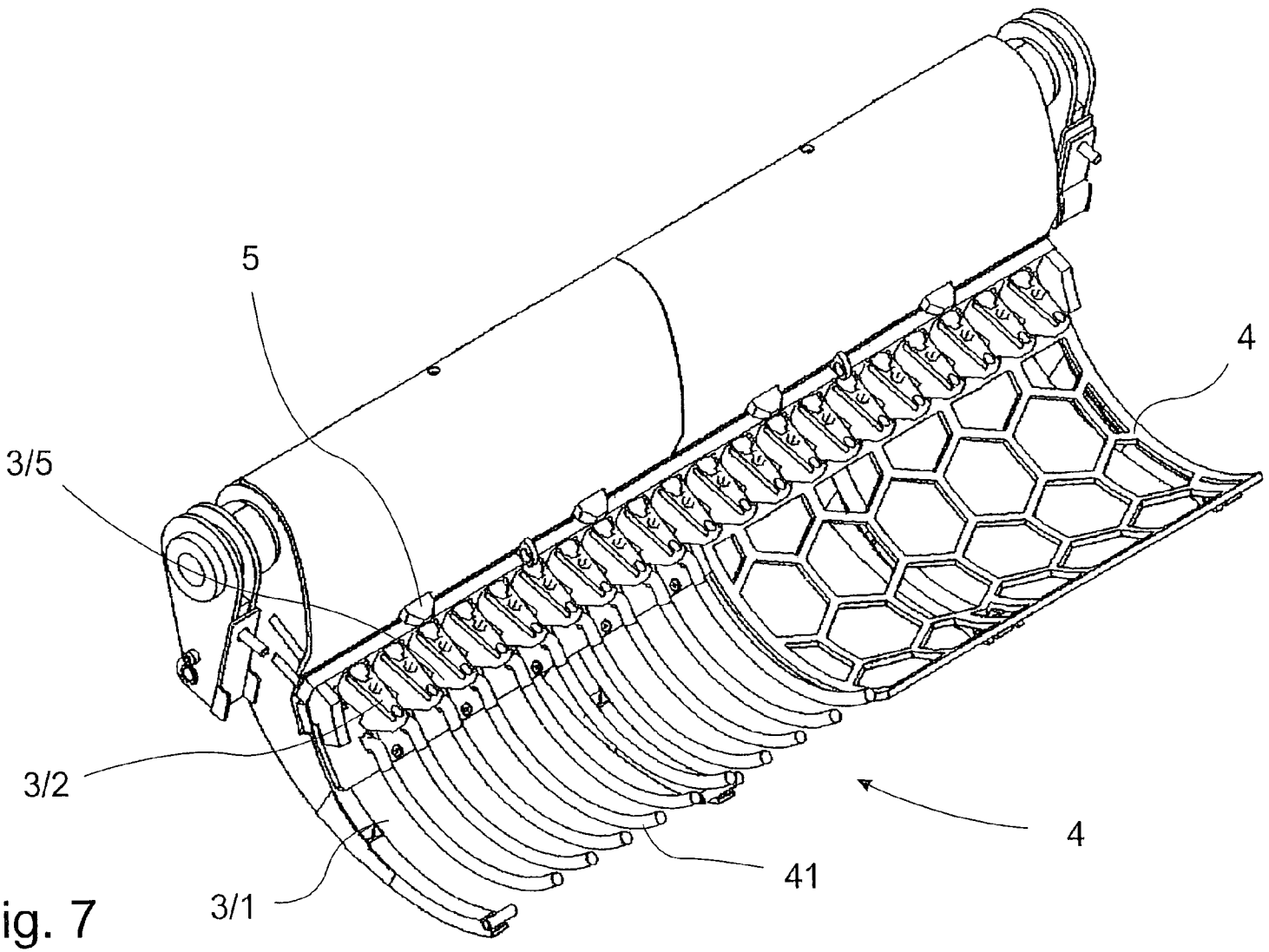
Figure 8:
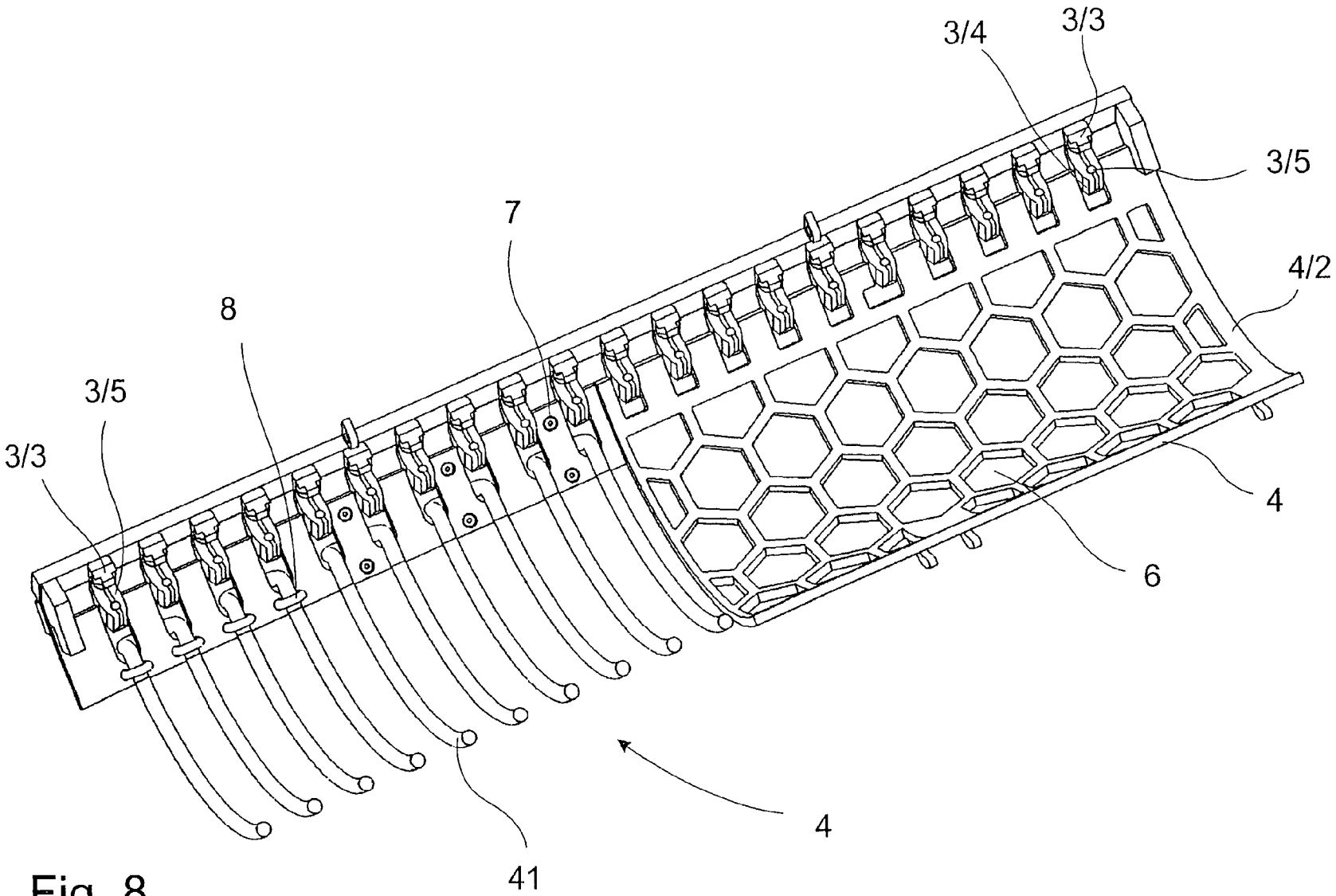

The invention is described in following by means of examples. In the figures:

FIG. 1 a three-dimensional drawing of a comminution device according to the invention, FIG. 2 a three-dimensional drawing according to FIG. 1 with another position of the sieve device, FIG. 3 a modification of the sieve device according to the invention, FIGS. 4 and 5 another design of the sieve device according to the invention in different angles of view, FIG. 6 a detail of the embodiments according to FIGS. 4 and 5, FIG. 7 a modification of the invention with two different solutions of the embodiment of a sieve device according to the invention, FIG. 8 a detail of the preceding FIG. 7, and FIGS. 9 to 11*c* other details of the embodiment of the sieve device with a spring.

FIG. 1 shows a three-dimensional drawing of a comminution device according to the invention, the complete comminution device being arranged in a housing I. In the housing I there is the comminution cylinder 1 on which the comminution tools 2 are arranged. Usually the comminution tools 2 are provided across the complete circumference of the comminution cylinder 1, a helical arrangement having been proved as convenient. Corresponding to the comminution cylinder 2 the sieve device 4 is arranged which is visible in FIG. 1 in a slightly swiveled-out position. At the sieve device 4 there is the counter cutter 3 which is formed, as shown in the drawing, by a number of individual counter cutters. The sieve device 4 also has openings 6 through which the comminuted material passes and gets in a not-shown transport device, for example a conveyor belt. The complete comminution device is set up on a set-up surface II. The comminution cylinder is here arranged slightly inclined with reference to this set-up surface II. In the drawing according to FIG. 1 it can be seen that the sieve device 4 and the counter cutter 3 form a common structural component which also can be taken out of the machine commonly and mounted again in the machine.

FIG. 2 then shows the device in its operating position in which the counter cutters and the sieve device are arranged much more closely to the comminution cylinder 1. The locking of the sieve device in this position can be carried out by hydraulic cylinders. However, these are not visible in the drawing according to neither FIG. 2 nor FIG. 1.

FIG. 3 shows an embodiment of a sieve device 4 with a modification of the embodiment for the counter cutter 3. The sieve device 4 is only shown schematically without the openings. The essential fact of the drawing according to FIG. 3 is the design of the counter cutter 3. The counter cutter 3 is here designed like a plate. The counter cutter here comprises several plate segments 3/6, 3/7, 3/8, 3/9. These individual segments 3/6, 3/7, 3/8, 3/9 can be exchanged individually in the case of wear. The attachment of these segments is done by means of wedges 5 which are locked either also hydraulically or mechanically. Of course, it is possible to provide other forms or possibilities of attachment. Thus a screw connection is also possible according to the invention like the design by means of locking bolts or the like. The counter cutter 3 has at its segments 3/6 to 3/9 wearing plates 3/2 which are arranged releasably fixed on a counter cutter support body 3/1. Attaching can be done usually by means of screws, clamping bolts or the like. The sieve device forms, according to the invention, together with the counter cutter a common structural component which can be inserted commonly in the machine and also removed together with it which leads to the advantageous effects described further above.

The modifications of the invention shown in FIGS. 4 and 5 are characterised in that the counter cutter 3 is formed by a number of single counter cutters 3/3. These counter cutters 3/3 are provided individually at the sieve device 4. Of course, also here suitable support bodies are provided in which the single counter cutters 3/3 can be set in. Preferably, these counter cutters, as indicated by the arrows a, b, are set in roughly vertically in the support body, and then swiveled downward so that they are already locked partly. Attaching is then done by means of a screw connection which is here also only indicated. The openings have in this embodiments the reference numbers 6, they are located in the segments 4/1 and 4/2 of the sieve device 4. Of course, it is possible to provide several segments depending on the size of the sieve device 4. The lockings of the sieve device at the machine frame are indicated as well. They serve for a fixed connection with the frame in the working condition. FIG. 5 shows the same embodiment of FIG. 4, however, in another angle of view. The reference numbers, as described before, are used in the same way.

FIG. 6 shows a detail of FIGS. 4 and 5. It can be seen here how the single counter cutters 3/3 are arranged on a support body 3/4. The counter cutters 3/3 are here sort of folded to the support body 3/5, and, after that, fixed with a screw or a bolt, not shown, which is guided through the boring 3/5 in the support body 3/4. Of course, also in the individual counter cutter 3/3 a boring is provided arranged correspondingly to the boring 3/5.

FIG. 7 shows, here only indicated schematically, the differences of two other modifications and embodiments of sieve devices 4 according to the invention. On the right hand side a sieve device 4 is shown with honey-combed openings. The honey combs are, of course, only shown in a certain size, and, naturally, can vary according to the respectively sieving task. For that purpose either the basket can be exchanged or, as already described above, also another size of the holes or openings can be reached by shifting two baskets of this type against each other.

In the left hand drawing of FIG. 7 a particularly advantageous embodiment for a sieve device for the comminution device according to the invention is shown. The sieve device is here formed by individual springs 41 which may be, however, also be designed, so to say, clasp-like (not visible in FIG. 7) with two limbs in order to get a better attaching. The springs 41 are here provided in the shown embodiment as round steel. It is in particular convenient if these springs 41 are made of springy material. All other reference numbers are, as described further back, used in the same way so that a new presentation is not necessary.

FIG. 8 shows details of the preceding FIG. 7. In particular the left hand side of the drawing shows that the springs 41 of the sieve device 4 are attached by means of different fastening means. This becomes even more clear in FIGS. 9 and 10. In FIG. 8 the springs 41 are fastened, for example, with fastening screws 7, which have on the back side another fastening means not visible in FIG. 8, namely a flange 7/2 and a corresponding nut 7/1. This becomes visible in FIG. 9. The springs 41 more to the left are attached by means of clips 8 to the console. This has only nuts on the back side to keep the springs in their pre-determined position.

Figure 9:
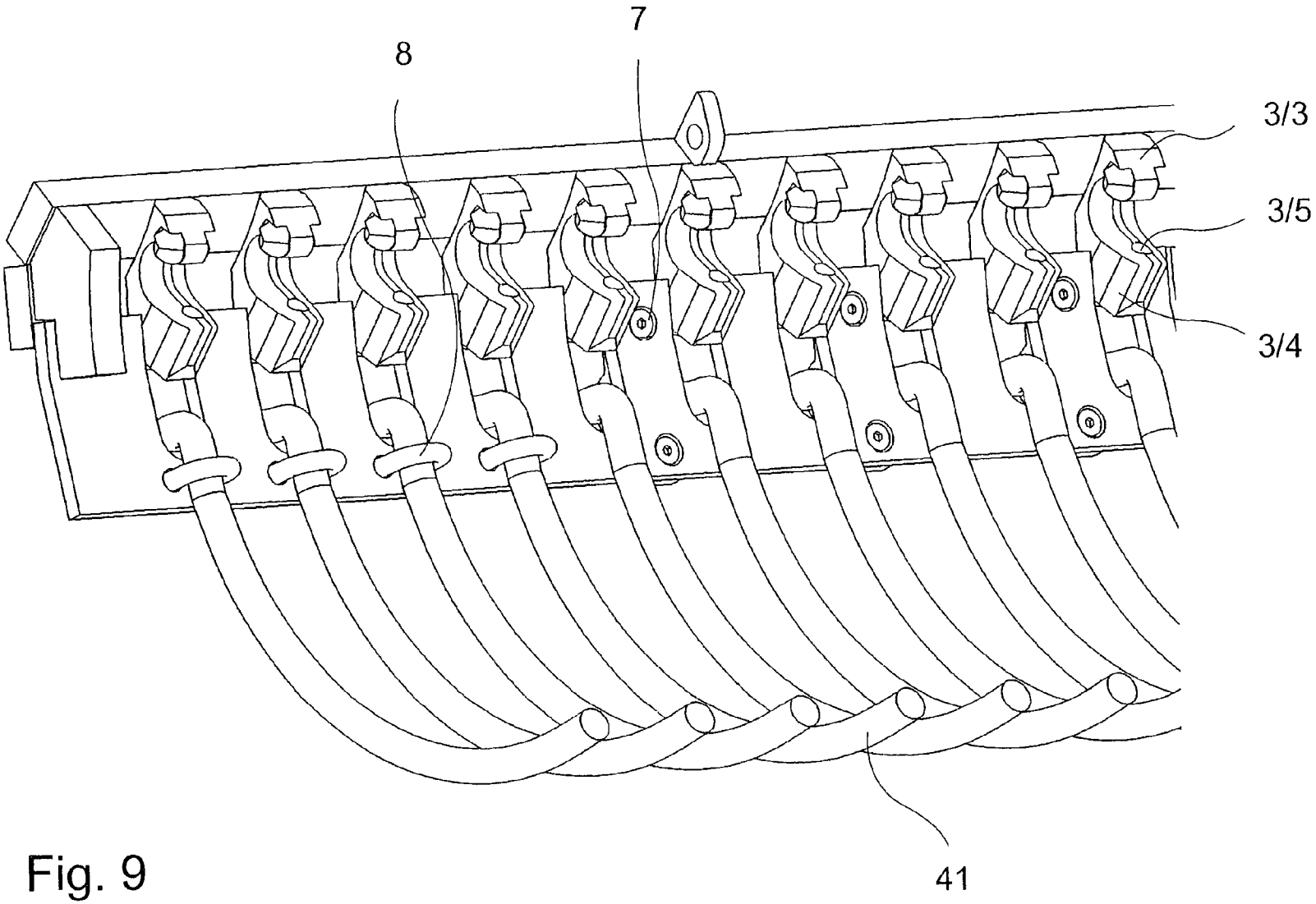

In FIG. 9 an enlargement of the solution described before is shown again. The reference numbers on the right hand side have already been explained before.

Figure 10:
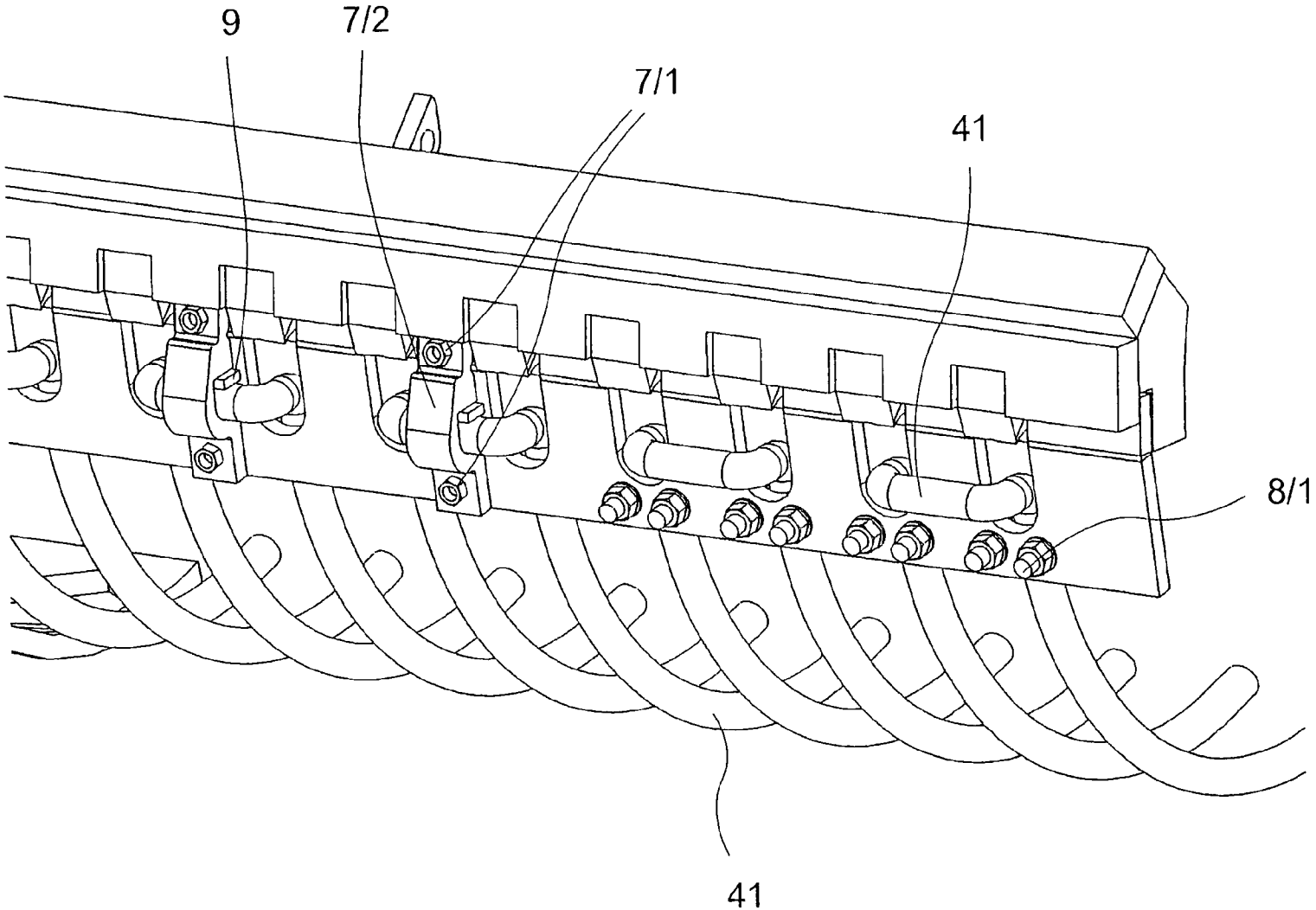

FIG. 10 shows the back side of FIGS. 8 and 9. There the flanges 7/2 as well as the back side of the clips 8 with their fastening nuts 8/1 are visible. In a development the fastening shown on the left hand side is also characterised in that a support plate 9 is arranged additionally, so to say, as wearing plate or torsion safety device.

Figure 11C:
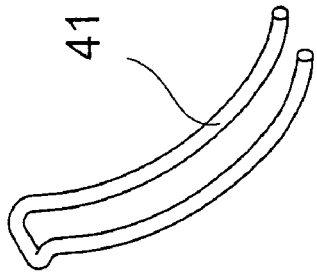
Figure 11A:
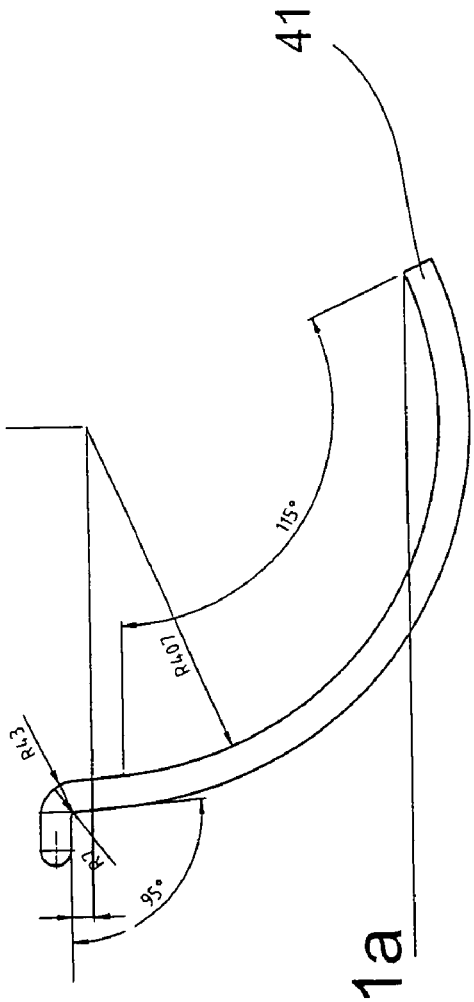
Figure 11B:
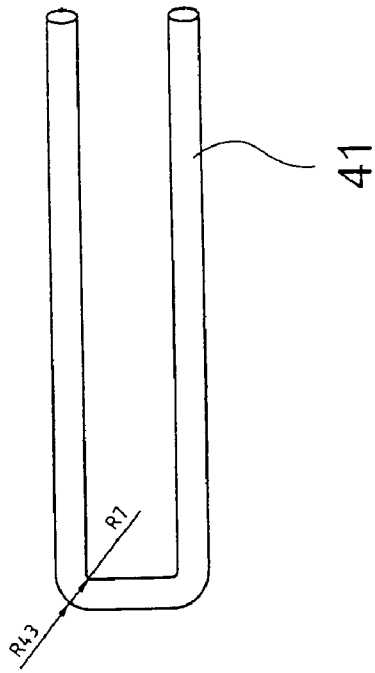

FIGS. 11*a* to 11*c* show preferred embodiments of the spring 41 according to the invention. Here the radius and the corresponding degree details are only meant for the preferred embodiment. Of course, the solution according to the invention comprises also other radius or degree numbers depending on how the diameter of the comminution cylinder has been selected. Furthermore, also the distance of the springs 41 to each other can vary.

The invention has been described before by means of examples. The claims filed now and to be filed later on with the application are attempted formulations without prejudice for obtaining a broader protection.

The references in the sub-claims refer to the other embodiment of the subject matter of the main claim through the characteristics of the respective sub-claim. However, they are not to be understood as a waiver of independent protection of the matter for the characteristics of the referred sub-claims.

Characteristics only disclosed in the description now so far, may be claimed, in the course of proceedings, claimed as being of inventive relevance, for example to distinguish from the state of the art.

The invention claimed is:

1. A comminution device comprising at least one comminution cylinder supported rotating in a machine frame with at least one comminution tool arranged on the at least one comminution cylinder, a counter cutter interacting with the at least one comminution tool, at least one sieve device for comminuted material, a housing at least partly encircling the at least one comminution cylinder, the at least one sieve device and the counter cutter forming a common structural component, the counter cutter including a plurality of counter cutter body segments extending across a complete width of the at least one comminution cylinder and having recesses designed corresponding to a shape of the at least one comminution tool, a plurality of wearing plates being provided in a direction of cutting on the plurality of counter cutter body segments, a plurality of wedges attaching the the plurality of wearing plates to the at least one sieve device with a separate one of said plurality of wedges being provided for each of said plurality of counter cutter body segments.

2. The comminution device according to claim 1, wherein the single counter cutter is arranged at the at least one sieve device in a direction of fitting in a top area of the at least one sieve device.

3. The comminution device according to claim 1, wherein the at least one sieve device has openings serving for fractionating the comminuted material and arranged facing a collecting side.

4. The comminution device according to claim 1, wherein a structural component includes the counter cutter and the at least one sieve device, the structural component is arranged in such a way that the structural component is swivelled away or towards the at least one comminution cylinder.

5. The comminution device according to claim 1, wherein openings of the at least one sieve device are provided and a width or size of the openings of the at least one sieve device is changeable.

6. The comminution device according to claim 1, wherein the at least one sieve device includes a basket, and individual segments form the basket.

7. The comminution device according to claim 6, wherein a flexible basket, formed by springs is provided additionally above the basket so that different sieve grainings are realized.

8. The comminution device according to claim 1, wherein the at least one sieve device is formed by rods arranged spaced from each other and form a basket of the at least one sieve device.

9. The comminution device according to claim 1, wherein an inset is provided as the at least one sieve device, and the inset is made of flexible material which is indifferent to interfering material.

10. The comminution device according to claim 1, wherein the at least one sieve device is formed by individual springs arranged one beside the other.

11. The comminution device according to claim 1, wherein the at least one sieve device is formed by individual springs arranged one beside the other and the springs are formed of one of round steel, square bar steel, polygonal steel, and oval steel.

12. The comminution device according to claim 1, wherein the at least one sieve device is formed by individual springs and the springs are attached to a console together with the single counter cutter, and the console is provided by swivelling in or at the comminution device.

13. The comminution device according to claim 1, wherein the at least one sieve device is formed by individual springs and the springs are attached to a carrier by fastening screws and flanges arranged on opposite sides and corresponding nuts, and at the flanges a support plate is provided serving as at least one of a wearing plate and a support for a torsion safety device of the springs.

14. The comminution device according to claim 12, wherein the at least one sieve device is formed by individual springs and the springs are attached to the console by clips bent around an angle of 95° seen from a side, and a radius of the bend is 407 mm.

15. The comminution device according to claim 14, wherein an exterior radius at a U-shaped clasp is 43 mm at an exterior bending radius and 7 mm at an interior bending radius.

16. The comminution device according to claim 1, wherein the at least one sieve device is arranged movably relatively to the machine frame and the at least one comminution cylinder has an electric or a hydraulic drive.

17. The comminution device according to claim 1, wherein a position of the at least one comminution cylinder and the at least one sieve device are orientated essentially horizontally.

18. The comminution device according to claim 1, wherein the at least one sieve device encircles the at least one comminution cylinder.

* * * * *